United States Patent [19]

Perry

[11] 4,386,470

[45] Jun. 7, 1983

[54] DRAFTING APPARATUS

[76] Inventor: David L. E. Perry, "Riversdale" Gisburn Rd., Long Preston, Near Skipton, North Yorkshire, England, BD23 4RA

[21] Appl. No.: 170,966

[22] Filed: Jul. 18, 1980

[30] Foreign Application Priority Data

Jul. 20, 1979 [GB] United Kingdom ..... 7925286

[51] Int. Cl.[3] ..... B43L 13/02

[52] U.S. Cl. ..... 33/438; 33/1 M

[58] Field of Search ..... 33/1 M, 430, 434, 143 M, 33/438, 125 M, 1 N, 441, 436

[56] References Cited

U.S. PATENT DOCUMENTS

| | | | |
|---|---|---|---|
| 3,742,609 | 7/1973 | Jeannet et al. | 33/143 M |
| 3,850,043 | 11/1974 | Tarbox | 33/1 M |
| 3,956,588 | 5/1976 | Whetstone et al. | 33/1 M |
| 3,958,336 | 5/1976 | Denroche | 33/1 M |
| 4,069,588 | 1/1978 | Hoppe | 33/1 M |
| 4,151,649 | 5/1979 | Tatsuzawa | 33/1 N |
| 4,221,056 | 9/1980 | Koenuma | 33/438 |
| 4,237,617 | 12/1980 | Goussios | 33/1 M |
| 4,241,512 | 12/1980 | Chikanobu et al. | 33/438 |

FOREIGN PATENT DOCUMENTS

| | | |
|---|---|---|
| 1066170 | 4/1967 | United Kingdom . |
| 1097979 | 1/1968 | United Kingdom . |
| 1309758 | 3/1973 | United Kingdom . |
| 1545414 | 5/1979 | United Kingdom . |

*Primary Examiner*—William D. Martin, Jr.
*Attorney, Agent, or Firm*—Holman & Stern

[57] ABSTRACT

Drafting apparatus comprises a drafting head having X and Y scribing edges. The drafting head is mounted for movement along a beam in the Y direction and its position is detected by an encoder. The beam is mounted for movement in the Y direction relative to the drawing surface and its position is detected by another encoder. The encoders control a numerical display device indicating instantaneous X and Y displacements of the scribing edges from a datum set by a zeroing control. A scaling device is arranged operatively between the encoders and the numerical display device whereby the numerical display device will indicate the real values represented by proportional X and Y displacements. The drafting head is rotatably mounted from a carriage and a third encoder detects the angular position of the drafting head and controls the numerical display device to indicate the instantaneous angular position of the drafting head.

21 Claims, 10 Drawing Figures

DRAFTING APPARATUS

Figure 1:
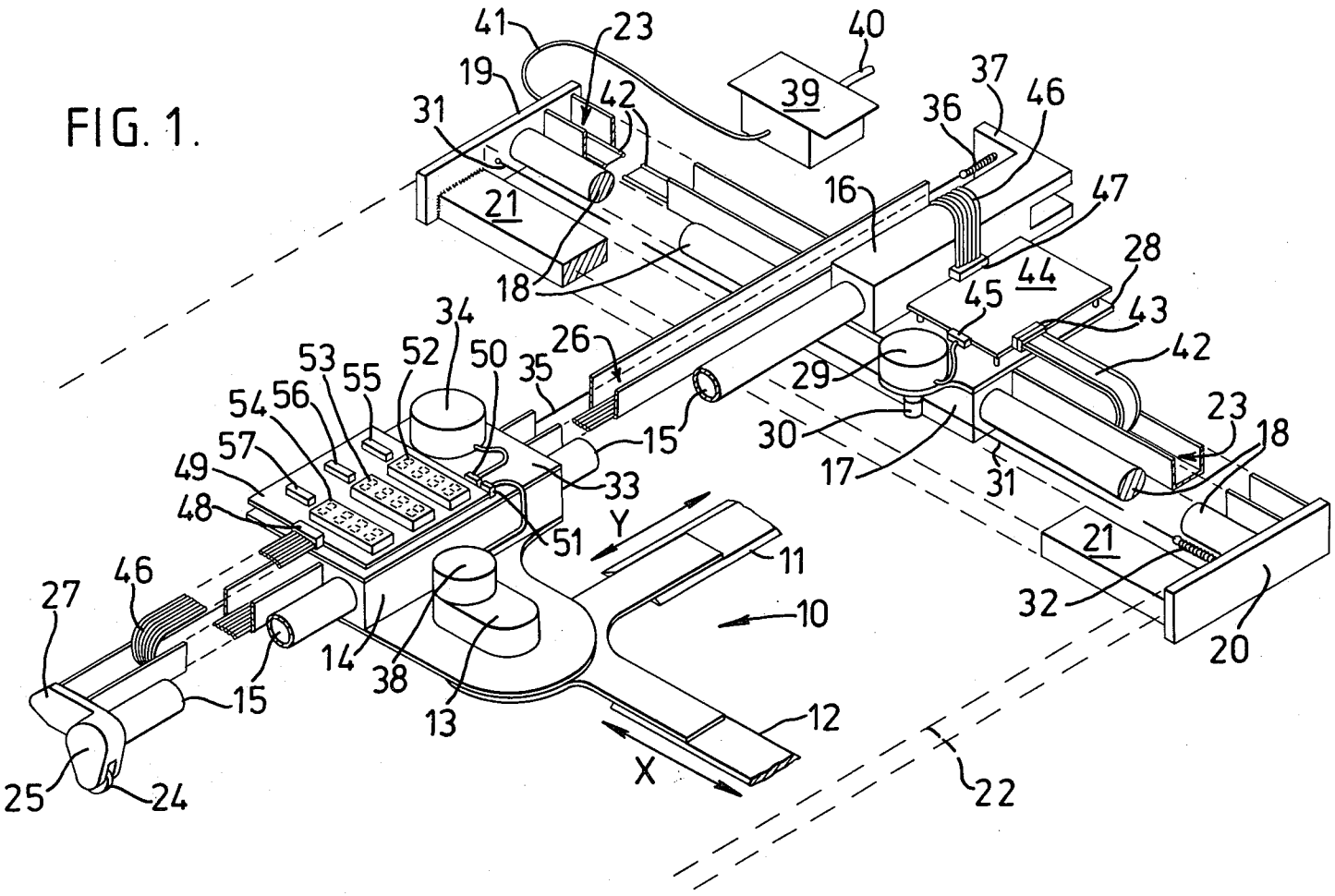

This invention relates to an improved drafting apparatus for making drawings, such as engineering, architectural or cartographical drawings, to a predetermined scale.

BACKGROUND OF THE INVENTION

UK Pat. No. 1320441 is concerned with drafting apparatus for measuring the co-ordinates of points and additionally for making a drawing in accordance with co-ordinates. It particularly teaches that the position of a drafting head can be read from separate X and Y scales as X and Y co-ordinates from a given zero co-ordinate. The X scale is mounted along the top edge of the drafting apparatus whilst the Y scale is mounted along a Y-bar or beam extending at right angles to the X scale. The draftsman is accordingly compelled to move to two separate positions to read the X and the Y co-ordinates of each point and the accuracy of each reading will consequently depend on the draftsman's personal skill in using the respective scale reading devices consistently.

Although the X and the Y co-ordinates are provided from a given zero co-ordinate, this is completely arbitrary and there is no provision for adjusting this zero co-ordinate to suit, for instance, a particular drawing, or to assist with the computation of dimensions on the drawing.

UK Pat. No. 1327658 is concerned with similar drafting apparatus and more particularly with the problem of conversion between metric and imperial systems of measurement. This patent specification teaches that this is achieved by providing dual X and Y scales and consequently fails to resolve the problems inherently associated with apparatus in accordance with UK Pat. No. 1320441.

BRIEF SUMMARY OF THE INVENTION

The present invention relates to drafting apparatus including a drafting head supported for movement in both the X direction and the Y direction relative to a drawing surface, a beam supported for movement in one of said directions, the drafting head being carried by the beam and being movable along the beam in the other of said directions, said drafting head having X and Y scribing edges, a first encoder for detecting the position of the beam in said one direction, a second encoder for detecting the position of the drafting head relative to the beam in the said other direction, and a numerical display device controlled by the encoders for indicating the instantaneous X and Y displacements of the said scribing edges from a predetermined datum. In this manner the accuracy of each reading is consistent and independent of the draftsman's skill or fatigue.

Furthermore, the numerical display device enables the X and Y displacements to be shown simultaneously in a position to suit the convenience of the draftsman thereby increasing the speed with which positions on the drawing surface can be fixed whilst simultaneously reducing fatigue.

The drafting head is preferably rotatably mounted from a carriage supported by the beam for movement along the beam in said other direction, a third encoder is provided for detecting the angular position of the drafting head and its scribing edges relative to the carriage, and the numerical display device also indicates the instantaneous angular position of the drafting head. In this manner the accuracy of each angular setting of the drafting head is also consistent and independent of the draftsman's skill or fatigue. Furthermore the numerical display device enables all information regarding the position and attitude of the drafting head to be displayed in the same general position.

The numerical display device preferably has a zeroing control means for establishing the datum for measuring the subsequent displacement of the drafting head. In this manner the draftsman can immediately set any zero datum he wishes thereby providing greater flexibility whilst facilitating the laying-out or measurement of all dimensions from any desired datum.

The numerical display device preferably has separate numerical displays for the X and Y displacements and for the angular position if the third encoder is provided, and the zeroing control means includes a separate zero control for each numerical display. The numerical display device is preferably carried by the drafting head or the carriage so that the draftsman can see all information regarding the position and attitude of the drafting head from the normal drawing position. The beam may conveniently be supported in the usual manner for movement in the X direction.

A scaling device is preferably arranged operatively between the numerical display device and the first and second encoder whereby the numerical display device will indicate the real values represented by proportional X and Y displacements of the drafting head. In this manner the draftsman can make a drawing to a fixed scale without the burden and risk to accuracy of having to convert each dimension before it is applied to or measured from the drawing. The scaling device can also be used for converting measurements from, say, imperial to metric measurements. The scaling means preferably includes means displaying the scale being used.

The first and/or second encoder may be connected to the numerical display device by ribbon cable positioned in an upwardly-facing channel and doubled over itself to permit corresponding full displacement of the drafting head. This enables the necessary electrical connections to be made between the various moving parts without resorting to sliding contacts.

The beam may be an extrusion defining the channel for the ribbon cable and also opposed rails which are engaged by wheels supporting the drafting head or the carriage if one is provided. A band preferably has its ends secured to the drafting head or the carriage if one is provided and is positioned over the channel for the ribbon cable whereby the ribbon cable is at all times covered by the band. The beam may be supported by wheels engaging opposed rails defined by a similar extrusion that is held in a fixed position relative to the drawing surface and also defines an upwardly-facing channel containing ribbon cable that is doubled over itself to permit full displacement of the drafting head in the said one direction. A band preferably has its ends secured to the beam and is positioned over the channel of the said similar extrusion whereby the associated ribbon cable is at all times covered by the band.

The first encoder may be carried by the beam and have a rotary input member driven by the movement of the beam relative to the drawing surface. The second encoder may be carried by the drafting head or the carriage, if one is provided, and have a rotary input member driven by the movement of the drafting head, or the carriage if one is provided, relative to the beam.

The first encoder may alternatively be held in a fixed position relative to the drawing surface and have a rotary input member driven by the movement of the beam relative to the drawing surface. The second encoder may alternatively be carried by the beam and have a rotary input member driven by the movement of the drawing head, or the carriage if one is provided, relative to the beam.

The or both encoders are preferably driven by a respective taut wire wrapped at least once around its rotary input member and secured to the corresponding relatively movable member.

In the case where a band has its ends secured to the drafting head, or the carriage if one is provided, the band may be supported by a pair of rollers mounted one at each end of the beam, and the second encoder is driven by one of these rollers. In the case where a band has its ends secured to the beam, the band may be supported by a pair of rollers mounted one at each end of the said similar extrusion, and the first encoder is driven by one of these rollers.

Each encoder preferably controls its numerical display device through a bi-directional counter and an arithmetic processor unit, and both arithmetic processor units are controlled by a common keyboard. Each bi-directional counter is preferably provided with a resetting facility for determining the datum from which corresponding displacement of the drafting head is measured.

Figure 2:
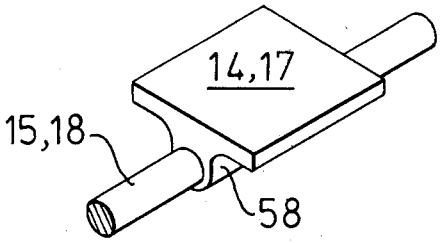
Figure 3:
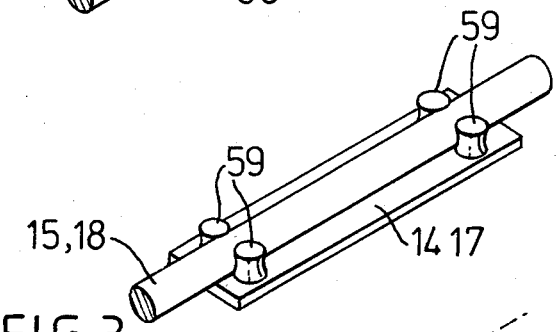
Figure 4:
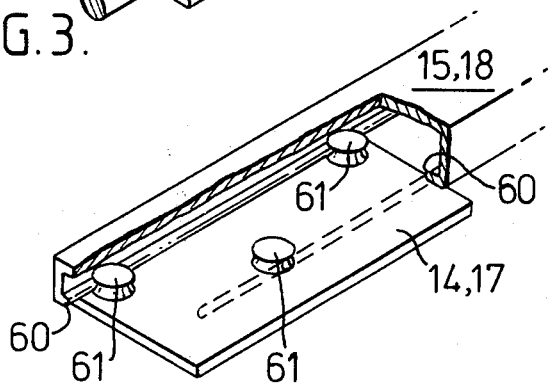
Figure 5:
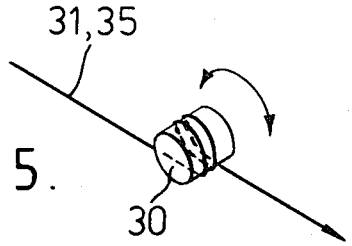
Figure 6:
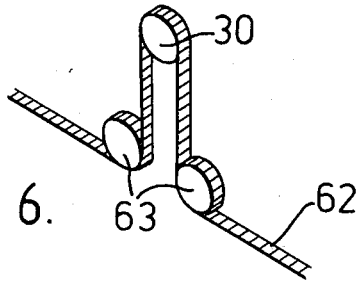
Figure 7:
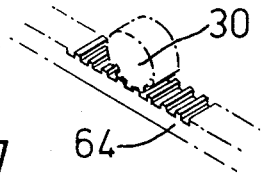
Figure 8:
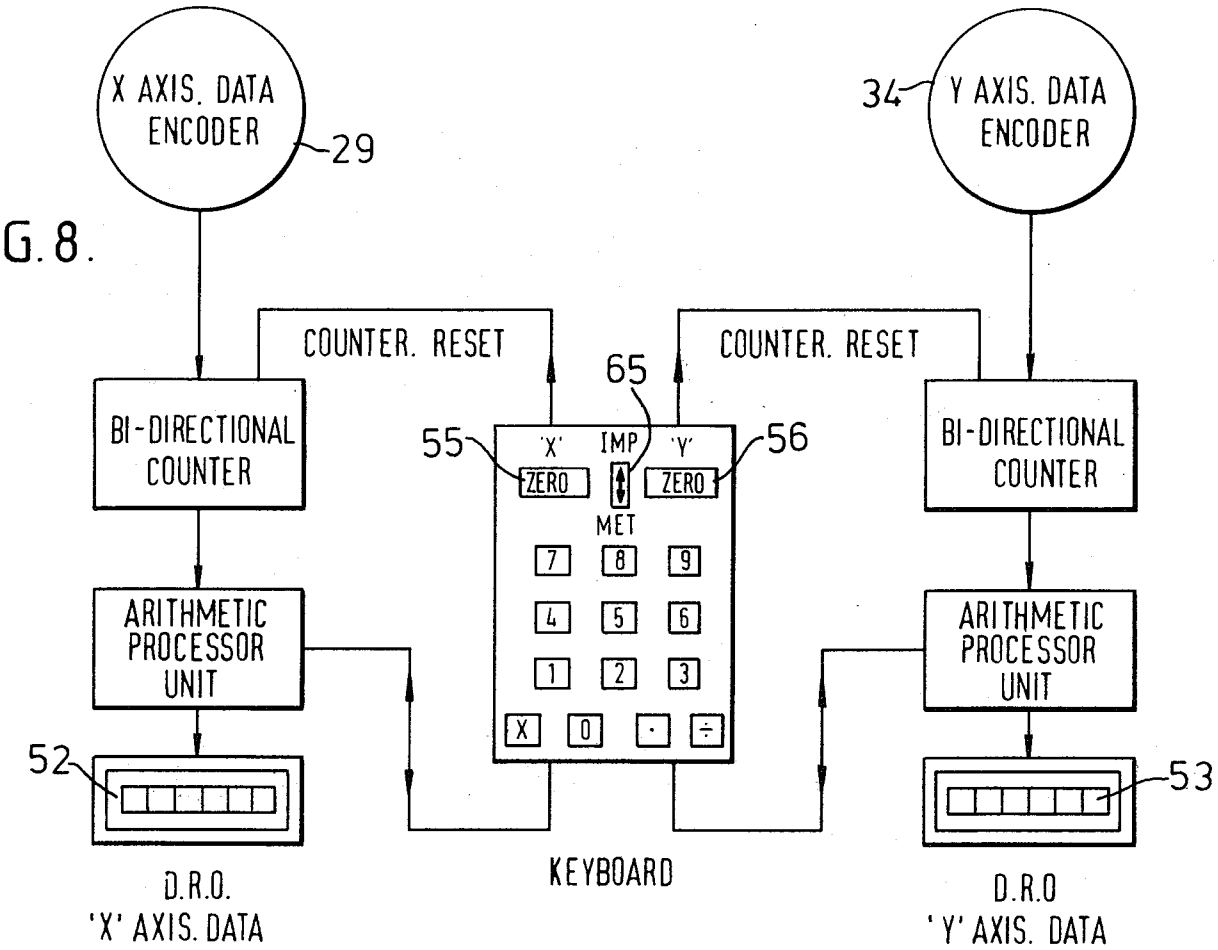
Figure 9:
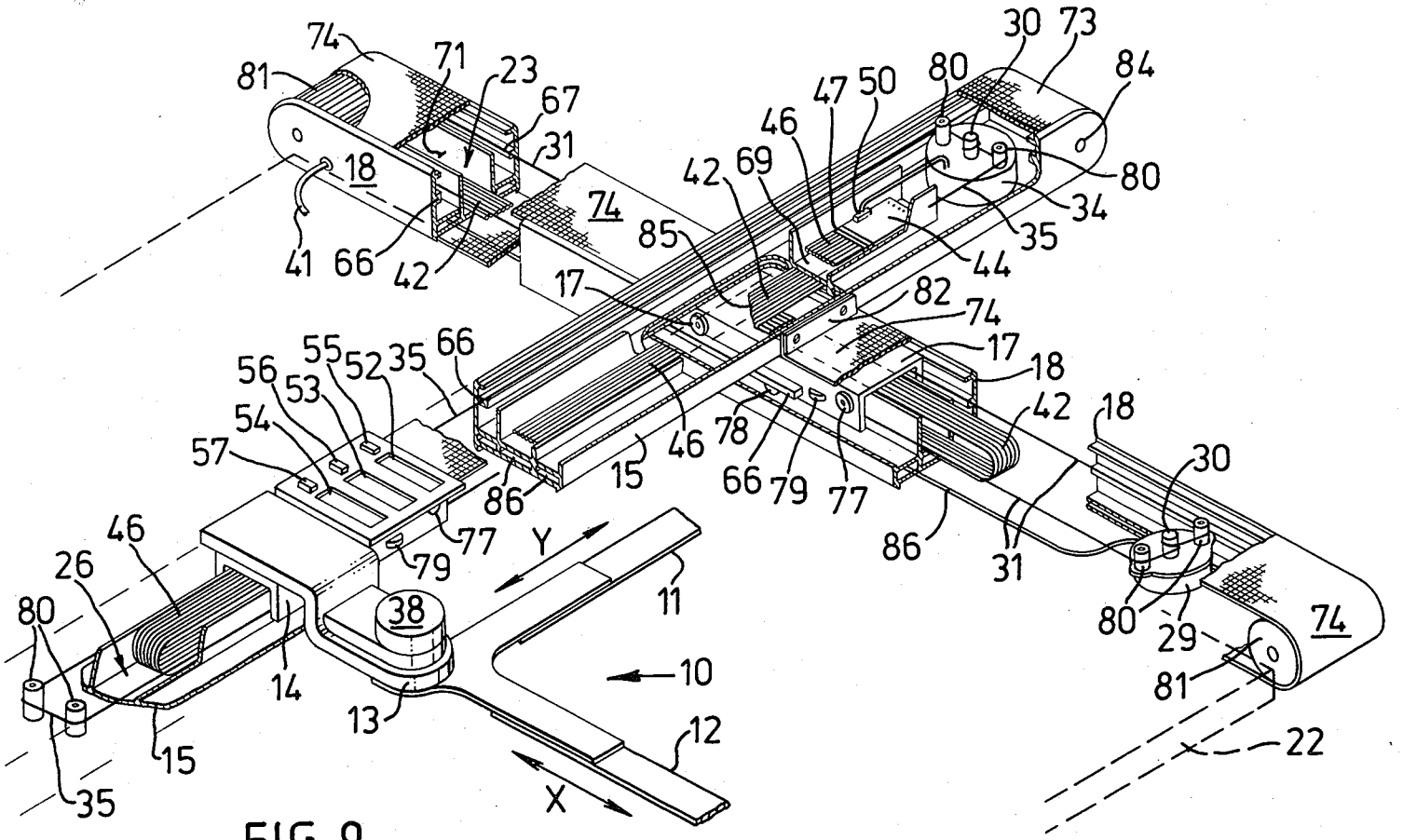
Figure 10:
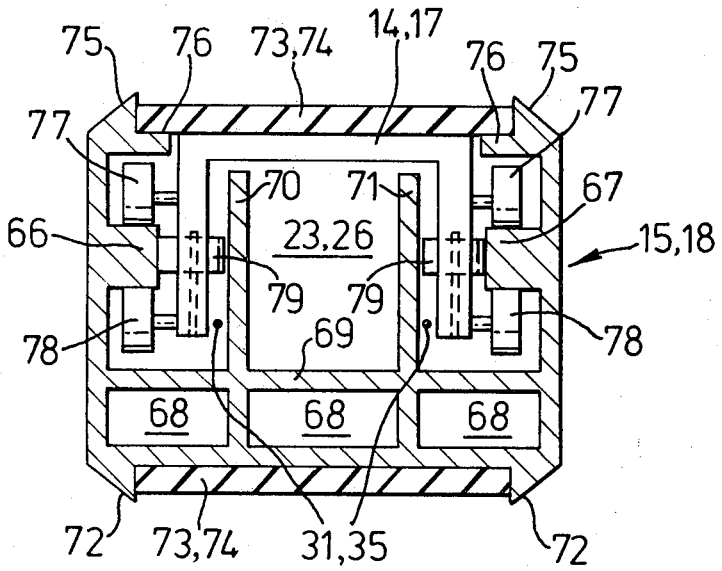

Other features of the invention will be appreciated from the following description of various embodiments, which are by way of example only, with reference to the accompanying drawings, in which:

FIG. 1 is a perspective view from above of one form of drafting apparatus, with various parts broken away, FIGS. 2 to 4 are diagrams illustrating alternative carriage mountings, FIGS. 5 to 7 are diagrams illustrating alternative encoder drives, FIG. 8 is a block diagram illustrating the control of numerical display device, FIG. 9 is a perspective view taken from a similar position to FIG. 1 but illustrating an alternative form of drafting apparatus, and FIG. 10 is an enlarged cross-section through the beam in FIG. 9.

Referring to FIG. 1 a drafting head 10 is provided with conventional scribing edges 11 and 12, for drawing lines respectively in the Y and X directions, and is mounted by a pivot 13 from a Y carriage 14 which is supported by an unseen low friction linear bearing from a tubular beam 15. The right-hand end of the beam 15 is carried by a block 16 secured to an X carriage 17 which is supported by an unseen linear ball race from a cylindrical guide rod 18. The two ends of the guide rod 18 are fixed to respective brackets 19, 20 that are welded to a rectangular bar 21 secured underneath the uppermost edge of the drawing board which is indicated generally in dotted lines 22. An upwardly-facing channel 23 is also fixed between the brackets 19 and 20.

In this manner the X carriage 17 is permitted to move in the X direction along the guide rod 18 within the limits permitted by the brackets 19 and 20, with corresponding movement of the block 16, beam 15 and the drafting head 10 over the drawing surface of the drawing board 22. The X carriage 17 is also capable of limited rotation about the guide rod 18 to enable the beam 15 and the drifting head 10 to be raised from the drawing surface. For this reason the left-hand end of the beam 15 is supported from the drawing board 22 by a wheel 24 carried by a bracket 25. A second upwardly-facing channel 26 is fixed between the block 16 and a lug 27 attached to the bracket 25.

The beam 15 is arranged at 90° to the axis of the guide rod 18 so that the Y carriage 14 and the drafting head 10 can be moved in the Y direction over the drawing surface of the drawing board 22 within the limits permitted by the block 16 and the lug 27.

A plate 28 is sandwiched between the block 16 and the X carriage 17 and carries an incremental shaft encoder 29 having a rotary input member in the form of a cylindrical pulley 30. A driving wire 31 has one end attached to the bracket 19, then passes one full turn around the pulley 30, and is kept taut by a tension coil spring 32 anchored to the bracket 20. Thus, as the X carriage 17 moves along the guide rod 18, the pulley 30 rotates the unshown shaft of the encoder 29 through an angle directly proportional to the X displacement of the drafting head 10.

A plate 33 is secured to the top of the Y carriage 14 and carries an incremental shaft encoder 34 of similar construction to the encoder 29 and driven in an equivalent manner by a driving wire 35 having one end attached to the lug 27 and its other end kept taut by a tension coil spring 36 anchored to a lug 37 formed integral with the block 16. Thus, as the Y carriage 14 moves along the beam 15, the unshown shaft of the encoder 34 is rotated through an angle directly proportional to the Y displacement of the drafting head 10.

In order to obtain a resolution at the drafting head 10 of about 0.1 mm. the encoders 29 and 34 would only have to produce 100 pulses per revolution provided their pulleys had a circumference of about 1 cm. Thus each encoder would be rotated through 360° for each centimeter of linear displacement which would be divided into hundredths, that is into increments of 0.1 mm. However, drawings are usually only made to an accuracy of 0.5 mm and the driving pulley circumference could therefore be increased to 5 cm or the encoders down-rated to produce only 20 pulses per revolution. As currently available encoders usually produce about 2,000 pulses per revolution it will be appreciated that there will be no problem in obtaining high degrees of accuracy, and furthermore that the invention would operate successfully with encoders of much lower resolution and of correspondingly lower cost.

The pivot 13 permits the drafting head 10 to be rotated through 360° so that the scribing edges can be angled relative to the X and Y axes. A third encoder 38 is mounted on the housing of the pivot 13 and is driven by an unshown gear train so that its output pulses are in direct relationship to the angular displacement of the drafting head 10. A clamp (not shown) is preferably provided for locking the drafting head 10 either in the position shown in which the bevelled scribing edges 11, 12 are respectively aligned with the Y and X axes, or in any adjusted angular position.

The mass of the Y carriage 14 and all attached components, including the drafting head 10, is counterbalanced by an equivalent cylindrical mass which is located inside the tubular beam 15 and is driven by a continuous wire or cord secured to the carriage and passing around pulleys at either and of the beam. Such counterbalance arrangements are well-known in the art and has not, for the sake of clarity, been illustrated.

A power supply unit 39 may conveniently be secured to the under face of the drawing board 22 although its position has been altered in the drawing for the sake of clarity. It is provided with a cable 40 for connection to a mains supply and it supplies a suitably transformed and rectified current for the logic circuits through wirings 41 having an unseen plug engaging an unseen socket which is mouned on the bracket 19 in line with the channel 23. A ribbon type cable 42 leads from this socket and comprises a plurality of parallely-spaced insulated conductors joined by a flexible web. The ribbon cable 42 lays in the channel 23 and, after passing below the X carriage 17, is doubled back over itself and connected by a multi-pin plug and socket 43 to a circuit board 44 mounted on the plate 28. It will be noted that the ribbon cable 42 is sufficiently long as to accommodate movement of the X carriage 17 to its furthest right-hand position so that a continuous electrical supply is maintained to the circuit board 44 throughout the full range of movement of the X carriage 17.

The circuit board 44 provides a bus bar system transmitting the electrical supply to the three encoders. As there is no relative movement between the encoder 29 and the circuit board 44, the encoder 29 is supplied directly through a simple plug and socket 45. However, as the encoders 34 and 38 move relatively to the circuit board, their electrical supply is transmitted through another ribbon cable 46 which lays in the channel 26 and has its upper end connected to the circuit board 44 by a multi-pin plug and socket 47. After passing below the Y carriage 14, the ribbon cable 46 is doubled back over itself and is connected by a multi-pin plug and socket 48 to a further circuit board 49 mounted on the plate 33. It will also be noted that the ribbon cable 46 is sufficiently long as to accommodate movement of the Y carriage 14 to the position furthest away from the block 16 so that a continuous electrical connection is maintained between the circuit boards 44 and 49 throughout the full range of movement of the Y carriage 14.

The carriage board 49 also includes a bus bar system from which encoders 34 and 38 are directly supplied through respective sample plugs and sockets 50 and 51.

The electrical pulses produced by the encoder 29, as the result of moving the drafting head 10 in the X direction, are transmitted back through the plug and socket 45 to the circuit board 44 from which they are transmitted, through the multi-pin plug and socket 47 and an appropriate conductor in the ribbon cable 46, to a processing circuit of the circuit board 49.

The electrical pulses produced by the encoder 34, as the result of moving the drafting head 10 in the Y direction, are transmitted back through the plug and socket 50 to another processing circuit of the circuit board 49. Similarly the electrical pulses produced by the encoder 38, as the result of changing the angular position of the drafting head 10, are transmitted back through the plug and socket 51 to a further processing circuit of the circuit board 49.

Digital displays 52, 53 and 54 are mounted on the circuit board 49 and are driven respectively by the processing circuits of the encoders 29, 34 and 38. These digital displays constitute a numerical display device controlled by the encoders for indicating the instantaneous X and Y displacements of the scribing edges 11 and 12 from a predetermined datum and also the instantaneous angular position of the drafting head 10.

The digital displays 52, 53 and 54 are provided with respective zeroing controls 55, 56, 57. The zeroing controls 55 and 56 may be pressed at any time to alter the datum from which the X and Y displacements respectively are measured. On the other hand the zeroing control 57 is useful when the apparatus is first turned on for ensuring that the digital display 54 is zeroed.

The various components and assemblies shown in FIG. 1 may be provided with appropriate detachable covers and the channels 23 and 26 may be provided with movable shutters similar to those that are described later with reference to FIGS. 9 and 10.

If desired the processing circuit for the electrical pulses produced by the encoder 29 may be arranged on the circuit board 44, the ribbon cable 46 being used for conveying the appropriate control signal to the digital display 52. The electrical pulses produced by either or both of the encoders 34 and 38 may be conveyed by the ribbon cable 46 to processing circuits on the circuit board 44, the ribbon cable being used for conveying the appropriate control signals respectively to the digital displays 53 and 54. Alternatively both circuit boards 44 and 49 may be used solely as a bus system for transmitting information from the encoders and the zeroing controls through the ribbon cable 42 to an external processing unit, and for transmitting control signals from such external processing unit to the digital displays. If desired, this last alternative could also provide a readily accessible output for driving other external equipment.

There are various alternative ways in which the carriages 14 and 17 can be mounted from their respective guide members 15, 18 and some of these are illustrated in FIGS. 2, 3 and 4. In FIG. 2 the carriage 14 or 17 is mounted from a cylindrical guide member 15 or 18 by means of a recirculating linear bearing positioned within a carriage extension 58 in a manner similiar to that used in FIG. 1. With the FIG. 3 arrangement the carriage 14 or 17 is provided with two pairs of opposed rollers 59 having contoured peripheries for positive location against the cylindrical surface of the guide member 15 or 18. The FIG. 4 embodiment uses an extrusion to form the guide member 15 or 18 and this is provided with a pair of opposed rails 60 which are engaged by three grooved rollers 61 arranged so that the carriage 14 or 17 is positively located. The invention can clearly be adapted for use with any track type of drafting machine.

There are also various alternative ways in which the pulley 30 of each encoder 29 or 34 can be driven. In FIG. 5 the pulley 30 is driven by a taut wire 31 or 35 wrapped around it in a manner similar to that used in FIG. 1 except that the wire is wrapped twice around the pulley. In FIG. 6 the pulley 30 is provided with teeth engaged by a toothed belt 62 which is led around a pair of idlers 63 to ensure that no slip can occur; the toothed belt 62 could be replaced by a chain if so desired. In FIG. 7 the pulley 30 is provided with gear teeth driven from a rack 64.

As the provision of the third encoder 38 is only an optional feature of the invention, the block diagram of FIG. 8 has been simplified just to illustrate the relationship of the various units driving the digital displays 52 and 53 providing the digital readout (D.R.O.) along the X and Y axes. This arrangement has however been further elaborated, from that described with reference to FIG. 1, to provide a scaling facility. As shown, each encoder 29, 34 supplies signals to a respective bi-directional counter for discriminating and quantifying movements in either direction along the respective axes.

Each bi-directional counter then drives its associated digital display 52, 53 through a respective arithmetic processor unit which is programmed so that each digital display will indicate the real values represented by proportional X and Y displacements of the drafting head. A common keyboard controls the program of both arithmetic processor units so that the draftsman merely has to press the zeroing controls 55 and 56 to set a convenient datum, and then key-in the scale to which he wishes to work. He is then able to mark off the scaled X and Y dimensions using the scribing edges 11 and 12 whilst seeing the real X and Y dimensions on the respective D.R.O. unit. The keyboard can thus by used to magnify or reduce the scale, or to change the system of measurement from imperial to metric by operating the toggle switch 65. The keyboard can be provided with an illumination system so that one of the abbreviations IMP or MET will be illuminated to establish whether dimensions are being given respectively in Imperial or Metric units, and so that operative keys are similarly illuminated to disclose the scale being used. Alternatively a separate read out display may be provided for this purpose preferably in close proximity to the other digital displays. The keyboard can be positioned either on the Y carriage 14 or perhaps more conveniently on a stationary part of the drafting apparatus.

Referring now to the alternative construction illustrated in FIGS. 9 and 10, it should be noted that the same reference numerals have been used to identify components equivalent to those already described with reference to FIG. 1, and that only the points of difference will be described.

The beam 15 and guide rail 18 are now formed from the same aluminium extrusion of which the cross-section is best seen from FIG. 10 as comprising an open topped U section provided with opposed rails 66, 67. The base of the extrusion is formed with three parallel cavities 68 having a common upper wall 69 forming the bottom of the channel 23 or 26 of which the side walls 70, 71 extend downwards to separate the cavities 68. The bottom of the extrusion is provided with a pair of lips 72 for locating a flexible band 73 or 74 which will be described later, and a similar pair of lips 75 are provided at the top of the extrusion for the same purpose on either side of narrow supporting flanges 76 for the band 73 or 74. The Y carriage 14 or X carriage 17 is mounted for axial movement within the extrusion by a first set of rollers 77 engaging the upper faces of the rails 66 and 67, a second set of rollers 78 engaging the under face of the rails 66 aand 67, and a third set of rollers 79 mounted with their axes normal to those of the other rollers and engaging the inwardly directed faces of the rails 66 and 67. In this manner the carriage 14 or 17 is constrained to move smoothly in a truly linear path. The cavities 68 form wiring conduits and serve to stiffen the extrusion.

With reference to FIG. 9, the guide rail 18 has its nearest vertical side secured along the upper edge of the drawing board 22 so that the X carriage 17 can slide freely along the full length of the guide rail 18. The X axis encoder 29 has been rearranged so that it is fixed underneath the guide rail 18 but has its pulley 30 positioned within the channel 23 to be driven by the taut wire 31 which is constrained by two pairs of guide rollers 80 to follow a rectangular path passing between the rails 66, 67 and the side walls 70, 71. On one side of its rectangular path the wire 31 is firmly connected to the X carriage 17.

The beam 15 is rigidly secured at right angles to the X carriage 17. Flexible band 74 is supported by a pair of rollers 81, mounted one at each end of the guide rail 18, and has its ends secured by screwed plates 82 to the opposite vertical sides of the beam 15. In this manner the band 74 is moved in unison with the X carriage 17 and serves to keep the open top of the guide rail 18 closed.

The Y carriage 14 is, as stated, supported from the beam 15 in the same manner as the X carriage 17 is supported from the guide rail, and carries the numerical display device 52, 53 and 54 plus a cranked bracket 83 for carrying the drafting head in close proximity to the drawing surface. The encoder 38 is driven coaxially through the pivot 13. The Y axis encoder 34 has also been moved and is now fixed underneath the top end of the beam 15 and has its pulley 30 positioned within the channel 26 to be driven by the taut wire 35 which is arranged in exactly the same manner as the taut wire 31.. The band 73 is supported by a pair of rollers 84 (only one shown), mounted one at each end of the beam 15, and has its ends secured to the Y carriage 14 so that it will move in unison with the Y carriage and keep the open top of the beam 15 closed.

The electronics are arranged in an unshown external electronics unit mounted underneath the drawing board 22 and connected to the drafting apparatus by a multi-cored cable 41 which is connected to the ribbon cable 42 through an unshown junction board fixed within the channel 23. The ribbon cable 42 is doubled back over itself as before, but is clamped to the underside of the X carriage 17 and then passes upwards through an unshown slot in the upper wall of the X carriage 17 and through an aligned slot in the beam 15 to one side of the flexible band 73. The ribbon cable 42 is then taken transversely across the beam 15 into the central cavity 68 where it is bent through 45°, as indicated by reference 85, so that its direction is changed to follow the central cavity 68 to a point where a portion of its upper wall 69 is cut away. At this point the ribbon cable 42 is connected to the junction board 44 which is connected by the multi-pin plug and socket 47 to the ribbon cable 46. The ribbon cable 46 is doubled back over itself as before but is clamped to the underside of the Y carriage 14 and emerges through an unshown slot cut in the upper wall of the Y carriage 14 and makes appropriate connections with a circuit board on which the encoder 38, the digital displays 52, 53, 54 and the zeroing controls 55, 56, 57 are mounted. The Y encoder 34 is connected by its plug and socket 50 to the junction board 44, and the X encoder 29 is connected by a cable 86 which extends through one of the cavities 68 to the unshown junction board between the multi-cored cable 41 and the ribbon cable 42.

If desired the encoder 29 could be mounted inside one of the rollers 81, preferably the one closest to the cable 41, the drive being either direct if the encoder produces sufficient pulses per revolution or by an appropriate gear train. Similarly the encoder 34 may be mounted inside the upper roller 84. In this manner the relative movement of each carriage is transmitted to its encoder by the associated flexible belt and the taut wires 31, 35 and guide rollers 80 will not be required.

Although the beam 15 has been shown in both embodiments as extending in the Y direction, it could of course be mounted in the X direction if so desired.

What is claimed is:

1. Drafting apparatus including a carriage supported for movement in both the X direction and the Y direction relative to a drawing surface, a beam supported for movement in one of said directions and defining an upwardly-facing channel, the carriage being supported by the beam and being movable along the beam in the other of said directions, a drafting head supported from the carriage and defining X and Y scribing edges, a first encoder driven by said movement of the beam to produce a first digital signal which is directly proportional to the position of the beam in said one direction, a second encoder driven by said movement of the carriage to produce a second digital signal which is directly proportional to the position of the drafting head relative to the beam in the said other direction, a first numerical display device operated by said first digital signal to indicate the instantaneous X displacement of the Y scribing edge from a predetermined X datum, a second numerical display device operated by said second digital signal to indicate the instantaneous Y displacement of the X scribing edge from a predetermined Y datum, said first and second numerical display devices are mounted on said carriage, a ribbon cable operatively connects the second encoder to the second numerical display device, and the ribbon cable is positioned in said upwardly-facing channel and is doubled over itself to permit corresponding full displacement of the drafting head relative to the beam.

2. Drafting apparatus, as in claim 1, in which said drafting head is supported by a pivot means from the carriage whereby the drafting head is rotatably mounted from the carriage, a third encoder is driven by rotational movement of said drafting head and its scribing edges to produce a third digital signal which is directly proportional to the angular position of the drafting head and its scribing edges relative to the carriage, a third numerical display device is operated by said third digital signal to indicate the instantaneous angular position of the drafting head, and the third numerical display device is also mounted on said carriage.

3. Drafting apparatus, as in claim 1, including a zeroing control means mounted on said carriage and operatively connected to the first and second numerical display devices to establish said predetermined datum for measuring the subsequent instantaneous X and Y displacements of the Y and X scribing edges.

4. Drafting apparatus, as in any of claims 1 to 3, in which the beam is an extrusion defining said upwardly-facing channel, opposed rails also defined by the extrusion, and the drafting head is supported by wheels engaging the rails.

5. Drafting apparatus, as in claim 1, including a band having both of its ends secured to the drafting head and being positioned over said upwardly-facing channel whereby the ribbon cable will at all times be covered by the band.

6. Drafting apparatus, as in any of claims 1 to 3 or 4, including an extrusion defining second upwardly-facing channel and opposed rails, said extrusion being held in a fixed position relative to the said drawing surface, and the beam is supported by wheels engaging the rails.

7. Drafting apparatus, as in claim 6, including a ribbon cable operatively connecting the first encoder to the first numerical display device, and the ribbon cable is positioned in the second upwardly-facing channel and is doubled over itself to permit full displacement of the beam in the said one direction.

8. Drafting apparatus, as in claim 7, including a band having both of its ends secured to the beam and being positioned over said second upwardly-facing channel whereby the ribbon cable will at all times be covered by the band.

9. Drafting apparatus, as in claim 8, including a pair of rollers mounted one at each end of the said extrusion, said band being supported by these rollers, and the first encoder is driven by one of these rollers.

10. Drafting apparatus, as in any of claims 1 to 3, in which the first encoder is carried by the beam and has a rotary input member driven by the movement of the beam relative to the drawing surface.

11. Drafting apparatus, as in any of claims 1 or 3, in which the second encoder is carried by the drafting head and has a rotary input member driven by the movement of the drafting head relative to the beam.

12. Drafting apparatus, as in any of claims 1 to 3, in which the first encoder is held in a fixed position relative to the drawing surface and has a rotary input member driven by the movement of the beam relative to the drawing surface.

13. Drafting apparatus, as in any of claims 1 to 3, in which the second encoder is carried by the beam and has a rotary input member driven by the movement of the drafting head relative to the beam.

14. Drafting apparatus, as in claim 5, including a pair of rollers mounted one at each end of the beam, said band being supported by these rollers, and the second encoder is driven by one of these rollers.

15. Drafting apparatus, as in claim 1, including a bi-directional counter and an arithmetic processor unit arranged operatively between each encoder and its numerical display device, and a common keyboard for controlling both arithmetic processor units.

16. Drafting apparatus, as in claim 15, including a resetting means for each bi-directional counter for determining the datum from which the corresponding displacement of the drafting head is measured.

17. Drafting apparatus, as in any of claims 1 to 3, including a scaling device arranged operatively between the numerical display device and the first and second encoders whereby the numerical display device will indicate the real values represented by proportional X and Y displacements of the drafting head.

18. Drafting apparatus, as in claim 17, in which the scaling device includes scale displaying means for displaying the scale being used, said scale displaying means being mounted on said carriage.

19. Drafting apparatus including a carriage supported for movement in both the X direction and the Y direction relative to a drawing surface, a member held in a fixed position relative to the drawing surface and defining an upwardly-facing channel, a beam supported from said member for movement in one of said directions, the carriage being supported by the beam and being movable along the beam in the other of said directions, a drafting head supported from the carriage and defining X and Y scribing edges, a first encoder driven by said movement of the beam to produce a first digital signal which is directly proportional to the position of the beam in said one direction, a second encoder driven by said movement of the carriage to produce a second digital signal which is directly proportional to the position of the drafting head relative to the beam in the said other direction, a first numerical display device operated by said first digital signal to indicate the instantaneous X displacement of the Y scribing edge from a predetermined X datum, a second numerical display device operated by said second digital signal to indicate the instantaneous Y displacement of the X scribing edge from a predetermined Y datum, said first and second numerical display devices are mounted on said carriage, a ribbon cable operatively connects the first encoder to the first numerical display device, and the ribbon cable is positioned in said upwardly-facing channel and is doubled over itself to permit full displacement of the beam in the said one direction.

20. Drafting apparatus, as in claim 19, including a band having both of its ends secured to the beam and being positioned over said upwardly-facing channel whereby the ribbon cable will at all times be covered by the band.

21. Drafting apparatus, as in claim 20, including a pair of rollers mounted one at each end of the said member, said band being supported by these rollers, and the first encoder is driven by one of these rollers.

* * * * *